US010685604B2

(12) United States Patent
Li

(10) Patent No.: US 10,685,604 B2
(45) Date of Patent: Jun. 16, 2020

(54) PIXEL DRIVING CIRCUIT AND DISPLAY DEVICE

(71) Applicant: Wuhan China Star Optoelectronics Technology Co., Ltd., Wuhan (CN)

(72) Inventor: Xue Li, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 16/331,988

(22) PCT Filed: Nov. 19, 2018

(86) PCT No.: PCT/CN2018/116281

§ 371 (c)(1),
(2) Date: Mar. 11, 2019

(65) Prior Publication Data

US 2020/0135108 A1 Apr. 30, 2020

(30) Foreign Application Priority Data

Oct. 29, 2018 (CN) ..... 2018 1 1271063

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2320/0626* (2013.01)

(58) Field of Classification Search
CPC ..... G09G 3/3233; G09G 3/3258; G09G 2320/043; G09G 2320/045; G09G 2320/0233
See application file for complete search history.

(56) References Cited

U.S. PATENT DOCUMENTS

2015/0356924 A1* 12/2015 Chen ..... G09G 3/3233 345/690
2016/0358546 A1* 12/2016 Ma ..... G09G 3/32
2017/0169761 A1* 6/2017 Ma ..... G09G 3/3233
2017/0177139 A1* 6/2017 Yang ..... G06F 3/0412
2019/0362674 A1* 11/2019 Xu ..... G09G 3/3241

* cited by examiner

*Primary Examiner* — Dong Hui Liang

(57) ABSTRACT

A pixel driving circuit and a display device are provided. The pixel driving circuit includes: a reset module, a compensation module electrically connected to the reset module, and a light emission module electrically connected to the compensation module. The reset module is configured to receive a reset control signal, and, in response to the reset control signal, reset the compensation module. The compensation module is configured to receive a scan signal, and, in response to the scan signal, receive a data signal and a compensation voltage, to complete performing threshold voltage compensation. The light emission module is configured to receive a light emission control signal, and, in response to the light emission control signal, emit light. Therefore, a threshold voltage is effectively compensated, and contrast of a displayed image is increased.

18 Claims, 8 Drawing Sheets

PIXEL DRIVING CIRCUIT AND DISPLAY DEVICE

RELATED APPLICATIONS

This application is a National Phase of PCT Patent Application No. PCT/CN2018/116281 having International filing date of Nov. 19, 2018, which claims the benefit of priority of Chinese Patent Application No. 201811271063.5 filed on Oct. 29, 2018. The contents of the above applications are all incorporated by reference as if fully set forth herein in their entirety.

FIELD AND BACKGROUND OF THE INVENTION

The present disclosure relates to a technical field of displays, and more particularly to a pixel driving circuit and a display device.

Organic light emitting diode (OLED) display devices have advantages of being self-luminous, having low driving voltages, high luminous efficiency, short response time, high sharpness and contrast, nearly 180° viewing angles, and wide operating temperature ranges, and allowing implementation of flexible displays and large area full color displays, etc., and have been commonly recognized by industry as display devices with the most development potential.

According to driving methods, OLED display devices may be divided into two types: passive matrix OLEDs (PMOLEDs) and active matrix OLEDs (AMOLEDs), i.e., two types: direct addressing and thin film transistor (TFT) matrix addressing. AMOLEDs have pixels arranged in arrays, belong to active display types, have high luminous efficiency, and are usually used for large scale display devices of high sharpness.

AMOLEDs are current-driven devices. When currents flow through OLEDs, OLEDs emit light, and luminance of emitted light is determined by currents flowing through OLEDs themselves. Most existing integrated circuits (ICs) only transmit voltage signals. Therefore, pixel driving circuits of AMOLEDs need to complete tasks of converting voltage signals into current signals.

Conventional AMOLED pixel driving circuits are usually 2T1C, i.e., with structures including two TFTs and one capacitor. Referring to FIG. 1, an existing 2T1C pixel driving circuit includes a first TFT T10, a second TFT T20, a capacitor C10, and an OLED D10. The first TFT T10 has a gate electrically connected to a drain of the second TFT T20, a source receiving a positive power supply voltage OVDD, and a drain electrically connected to an anode of the OLED D10. The second TFT T20 has a gate receiving a gate driving signal Gate, a source receiving a data signal Data, and the drain electrically connected to the gate of the first TFT T10. The capacitor C10 has an end electrically connected to the gate of the first TFT T10, and the other end electrically connected to the source of the first TFT T10. The OLED D10 has the anode electrically connected to the drain of the first TFT T10, and a cathode receiving a negative power supply voltage OVSS. When the 2T1C AMOLED pixel driving circuit operates, a current flowing through the OLED D10 satisfies the following equation.

$$I=k\times(Vsg-Vth)^2$$

where I is the current flowing through the OLED D10, k is a constant coefficient related to characteristics of the first TFT T10, Vsg is a voltage difference between the source and the gate of the first TFT T10, and Vth is a threshold voltage of a driving TFT (i.e. first TFT T10). It can be seen that the current flowing through the OLED D10 is related to the threshold voltage of the driving TFT.

Due to reasons, such as unstable manufacturing processes, a threshold voltage of a driving TFT of each pixel driving circuit in panels is different. After TFTs are used for a long time, TFT material aging and varying occur, causing threshold voltages of driving TFTs to drift, resulting in a problem that currents flowing through OLEDs are unstable. Therefore, panels display non-uniformly. In conventional 2T1C circuits, threshold voltage drift of driving TFTs cannot be improved by adjustment. Therefore, new TFTs or new signals need to be added, in order to reduce impacts of threshold voltage drift. That is, AMOLED pixel driving circuits are caused to have compensation functions.

SUMMARY OF THE INVENTION

An object of the present disclosure is to provide a pixel driving circuit that effectively compensates a threshold voltage, and increases contrast of a displayed image.

Another object of the present disclosure is to provide a display device that effectively compensates a threshold voltage, and increases contrast of a displayed image.

In order to solve the aforementioned problem, the present disclosure provides a pixel driving circuit including: a reset module, a compensation module electrically connected to the reset module, and a light emission module electrically connected to the compensation module;

wherein the reset module is configured to receive a reset control signal, and, in response to the reset control signal, reset the compensation module;

wherein the compensation module is configured to receive a scan signal, and, in response to the scan signal, receive a data signal and a compensation voltage, and perform threshold voltage compensation; and wherein the light emission module is configured to receive a light emission control signal, and, in response to the light emission control signal, emit light.

The compensation module includes: a first thin film transistor (TFT), a second TFT, a third TFT, a fourth TFT, and a storage capacitor;

wherein the first TFT has a gate receiving the scan signal, a source electrically connected to a first node, and a drain electrically connected to a second node;

wherein the second TFT has a gate receiving the scan signal, a source receiving the compensation voltage, and a drain electrically connected to a third node;

wherein the third TFT has a gate receiving the scan signal, a source receiving the data signal, and a drain electrically connected to a fourth node;

wherein the fourth TFT has a gate electrically connected to the first node, a source electrically connected to the second node, and a drain electrically connected to the third node;

wherein the storage capacitor has two ends correspondingly electrically connected to the first node and the fourth node; and wherein the reset module is electrically connected to the first node and the fourth node, and the light emission module is electrically connected to the second node, the third node, and the fourth node.

The reset module includes: a fifth TFT;

wherein the fifth TFT has a gate receiving the reset control signal, a source electrically connected to the first node, and a drain electrically connected to the fourth node.

The light emission module includes: a sixth TFT, a seventh TFT, an eighth TFT, and an electroluminescence (EL) element;

wherein the sixth TFT has a gate receiving the light emission control signal, a source receiving a high power supply voltage, and a drain electrically connected to the third node;

wherein the seventh TFT has a gate receiving the light emission control signal, a source electrically connected to the second node, and a drain electrically connected to an anode of the EL element;

wherein the eighth TFT has a gate receiving the light emission control signal, a source electrically connected to the third node, and a drain electrically connected to the fourth node; and wherein a cathode of the EL element receives a low power supply voltage.

An operating process of the pixel driving circuit includes: a reset stage, a compensation stage, and a light emission stage in order;

wherein during the reset stage, the reset control signal is asserted, and the scan signal and the light emission control signal are deasserted;

wherein during the compensation stage, the scan signal is asserted, and the reset control signal and the light emission control signal are deasserted; and wherein during the light emission stage, the light emission control signal is asserted, and the reset control signal and light emission control signal are deasserted.

The first TFT, the second TFT, the third TFT, the fourth TFT, the fifth TFT, the sixth TFT, the seventh TFT, and the eighth TFT are N-type TFTs;

wherein when each of the reset control signal, the scan signal, and the light emission control signal is asserted, each of the reset control signal, the scan signal, and the light emission control signal is at a high voltage level; and wherein when each of the reset control signal, the scan signal, and the light emission control signal is deasserted, each of the reset control signal, the scan signal, and the light emission control signal is at a low voltage level.

During the reset stage, a voltage of the first node is equal to a voltage of the fourth node.

During the compensation stage, a voltage of the fourth node is equal to a voltage of the data signal, a voltage of the first node is equal to a sum of the compensation voltage and a threshold voltage of the fourth TFT.

During the light emission stage, a voltage of the fourth node is equal to the high power supply voltage, a voltage of the first node is equal to a difference between a sum of the compensation voltage, a threshold voltage of the fourth TFT, and the high power supply voltage, and a voltage of the data signal.

The present disclosure provides a display device including: any of the aforementioned pixel driving circuits.

Advantages of the present disclosure are as follows. The pixel driving circuit includes: a reset module, a compensation module electrically connected to the reset module, and a light emission module electrically connected to the compensation module. The reset module is configured to receive a reset control signal, and, in response to the reset control signal, reset the compensation module. The compensation module is configured to receive a scan signal, and, in response to the scan signal, receive a data signal and a compensation voltage, to complete performing threshold voltage compensation. The light emission module is configured to receive a light emission control signal, and, in response to the light emission control signal, emit light. Therefore, a threshold voltage is effectively compensated, and contrast of a displayed image is increased. The present disclosure also provides a display device that effectively compensates a threshold voltage, and increases contrast of a displayed image.

BRIEF DESCRIPTION OF THE SEVERAL VIEWS OF THE DRAWINGS

In order to further understand features and technical content of the present disclosure, please refer to the detail description and the drawings of the present disclosure below. However, the drawings are only used for reference and for illustration, and are not used to limit the present disclosure.

In the drawings.

DESCRIPTION OF SPECIFIC EMBODIMENTS OF THE INVENTION

In order to further describe technical means used by the present disclosure and effects thereof, preferred embodiments of the present disclosure are described in detail below in conjunction with the drawings thereof.

Figure 1:
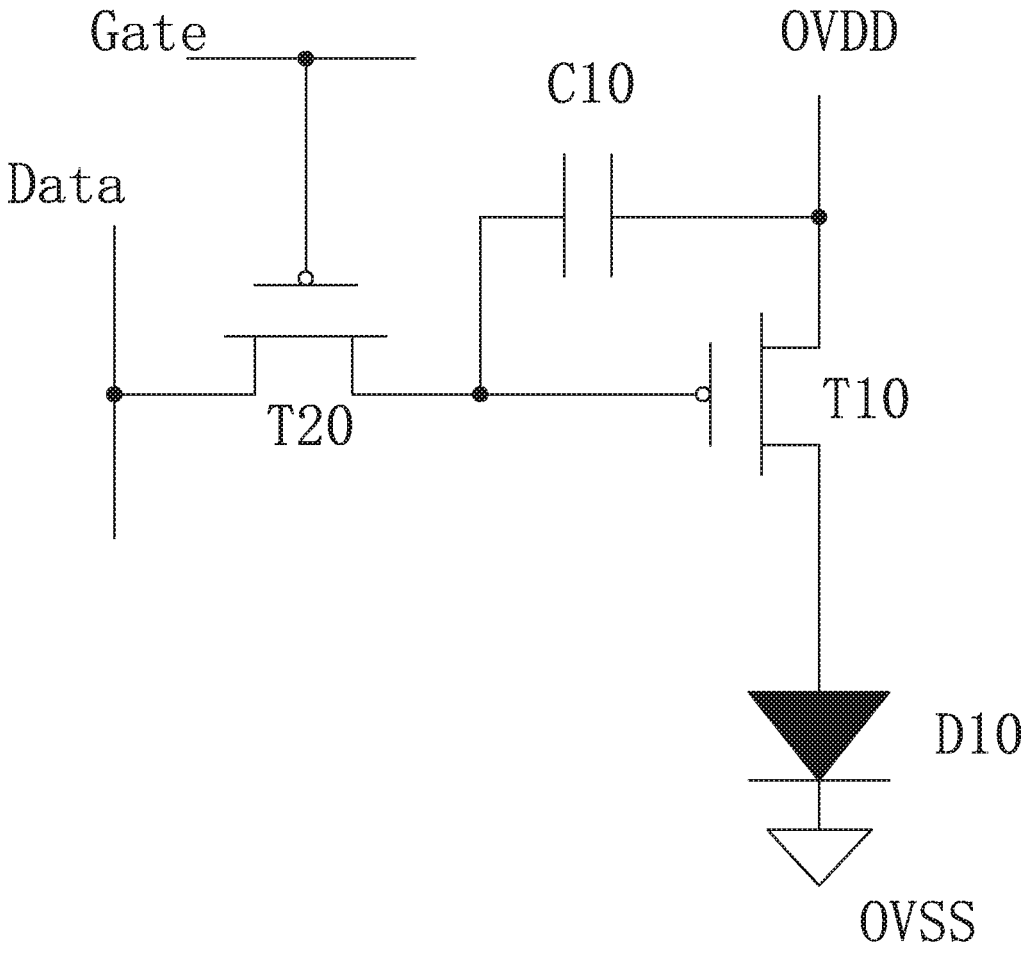
FIG. 1 PRIOR ART
FIG. 1 is a circuit diagram of an existing pixel driving circuit.
Figure 2:
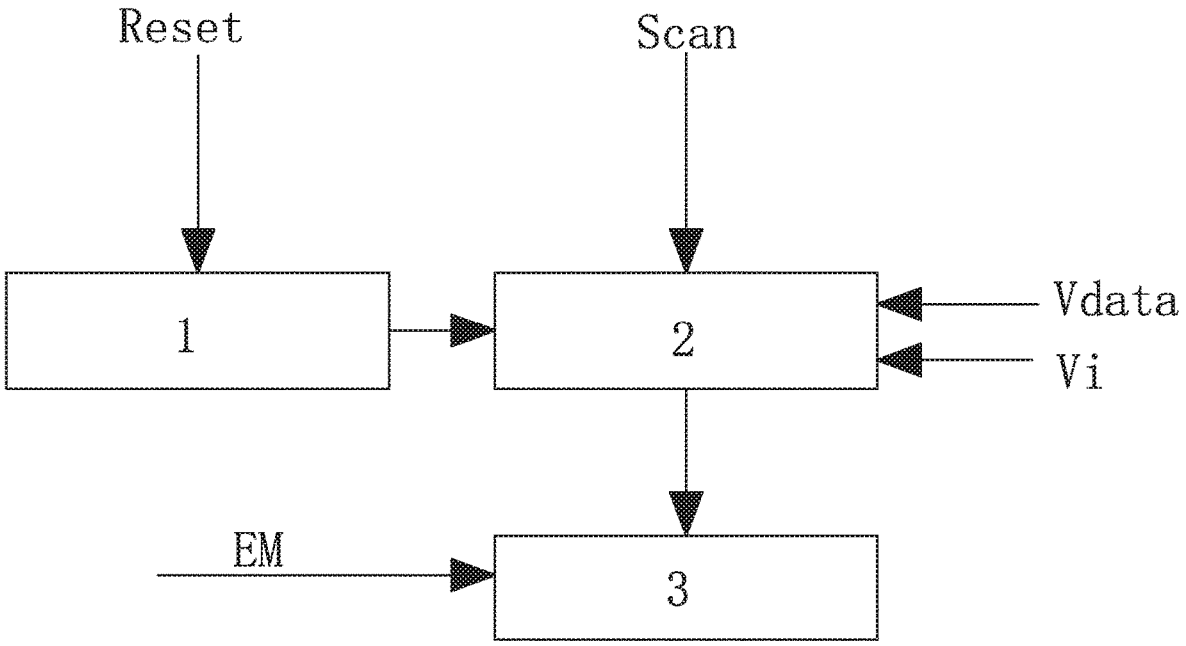
FIG. 2 is a block diagram of a pixel driving circuit in accordance with the present disclosure.

Referring to FIG. 2, the present disclosure provides a pixel driving circuit including: a reset module 1, a compensation module 2 electrically connected to the reset module 1, and a light emission module 3 electrically connected to the compensation module 2.

The reset module 1 is configured to receive a reset control signal Reset, and, in response to the reset control signal Reset, reset the compensation module 2.

The compensation module 2 is configured to receive a scan signal Scan, and, in response to the scan signal Scan, receive a data signal Data and a compensation voltage Vi, and perform threshold voltage compensation.

The light emission module 3 is configured to receive a light emission control signal EM, and, in response to the light emission control signal EM, emit light.

Figure 3:
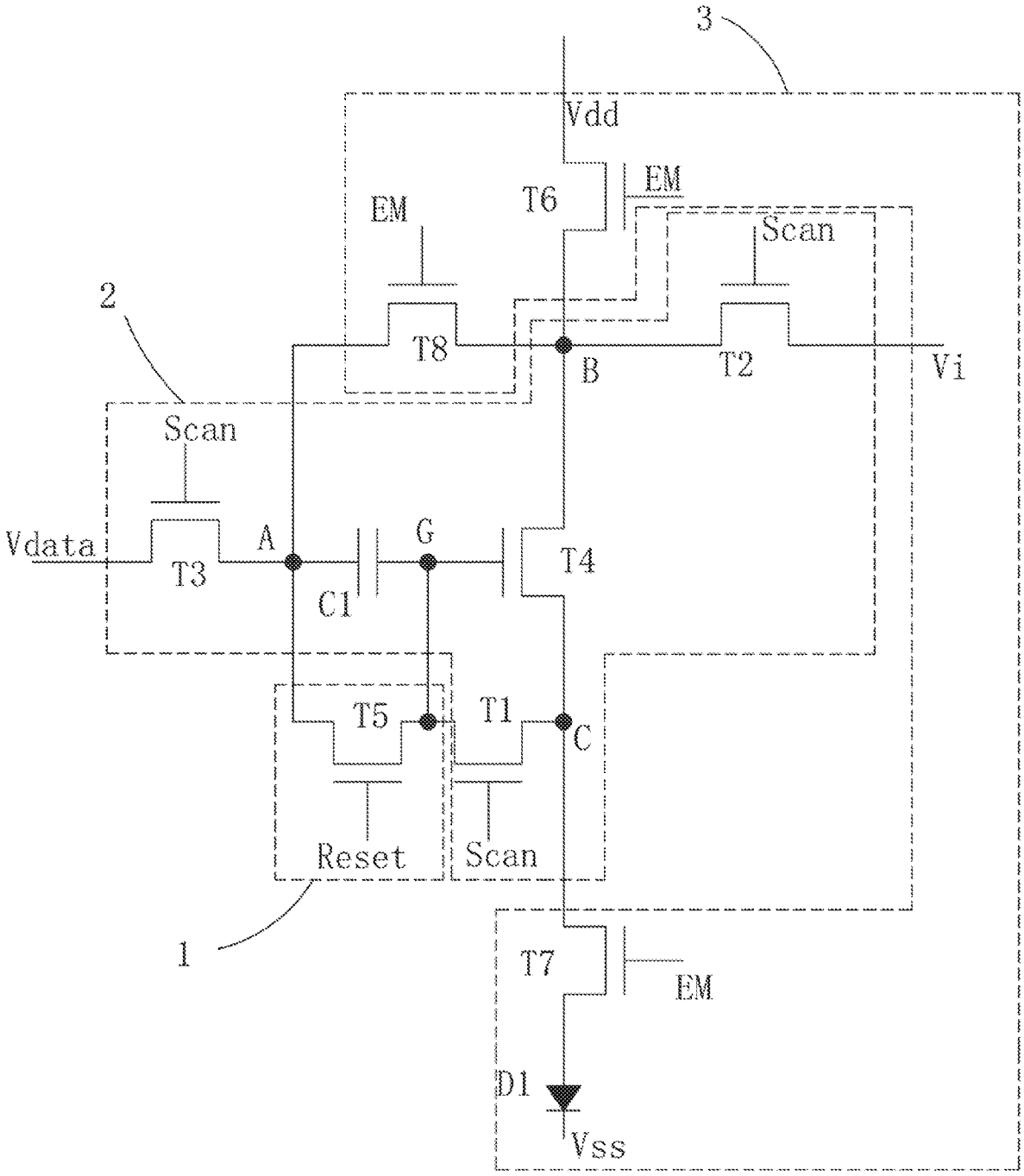
FIG. 3 is a circuit diagram of a pixel driving circuit in accordance with the present disclosure.

Specifically, as illustrated in FIG. 3, the compensation module 2 in an embodiment of the present disclosure specifically includes: a first thin film transistor (TFT) T1, a second TFT T2, a third TFT T3, a fourth TFT T4, and a storage capacitor C1.

The first TFT T1 has a gate receiving the scan signal Scan, a source electrically connected to a first node G, and a drain electrically connected to a second node C.

The second TFT T2 has a gate receiving the scan signal Scan, a source receiving the compensation voltage Vi, and a drain electrically connected to a third node B.

The third TFT T3 has a gate receiving the scan signal Scan, a source receiving the data signal Data, and a drain electrically connected to a fourth node A.

The fourth TFT T4 has a gate electrically connected to the first node G, a source electrically connected to the second node C, and a drain electrically connected to the third node B.

The storage capacitor C1 has two ends correspondingly electrically connected to the first node G and the fourth node A.

The reset module 1 is electrically connected to the first node G and the fourth node A, and the light emission module 3 is electrically connected to the second node C, the third node B, and the fourth node A.

Further, as illustrated in FIG. 3, the reset module 1 specifically includes: a fifth TFT T5.

The fifth TFT T5 has a gate receiving the reset control signal Reset, a source electrically connected to the first node G, and a drain electrically connected to the fourth node A.

Further, as illustrated in FIG. 3, the light emission module 3 specifically includes: a sixth TFT T6, a seventh TFT T7, an eighth TFT T8, and an electroluminescence (EL) element D1.

The sixth TFT T6 has a gate receiving the light emission control signal EM, a source receiving a high power supply voltage Vdd, and a drain electrically connected to the third node B.

The seventh TFT T7 has a gate receiving the light emission control signal EM, a source electrically connected to the second node C, and a drain electrically connected to an anode of the EL element D1.

The eighth TFT T8 has a gate receiving the light emission control signal EM, a source electrically connected to the third node B, and a drain electrically connected to the fourth node A.

A cathode of the EL element D1 receives a low power supply voltage Vss.

Specifically, in the present embodiment, the EL element D1 is an organic light emitting diode (OLED). The first TFT T1, the second TFT T2, the third TFT T3, the fourth TFT T4, the fifth TFT T5, the sixth TFT T6, the seventh TFT T7, and the eighth TFT T8 are amorphous silicon TFTs, low temperature polysilicon TFTs, or metal oxide semiconductor TFTs.

Preferably, in the present embodiment, the first TFT T1, the second TFT T2, the third TFT T3, the fourth TFT T4, the fifth TFT T5, the sixth TFT T6, the seventh TFT T7, and the eighth TFT T8 are N-type TFTs. N-type TFTs are conducting in high voltage level states, and are cutoff in low voltage level states.

Specifically, the reset control signal Reset, the scan signal Scan, and the light emission control signal EM are all provided by an external timing controller.

Figure 4:
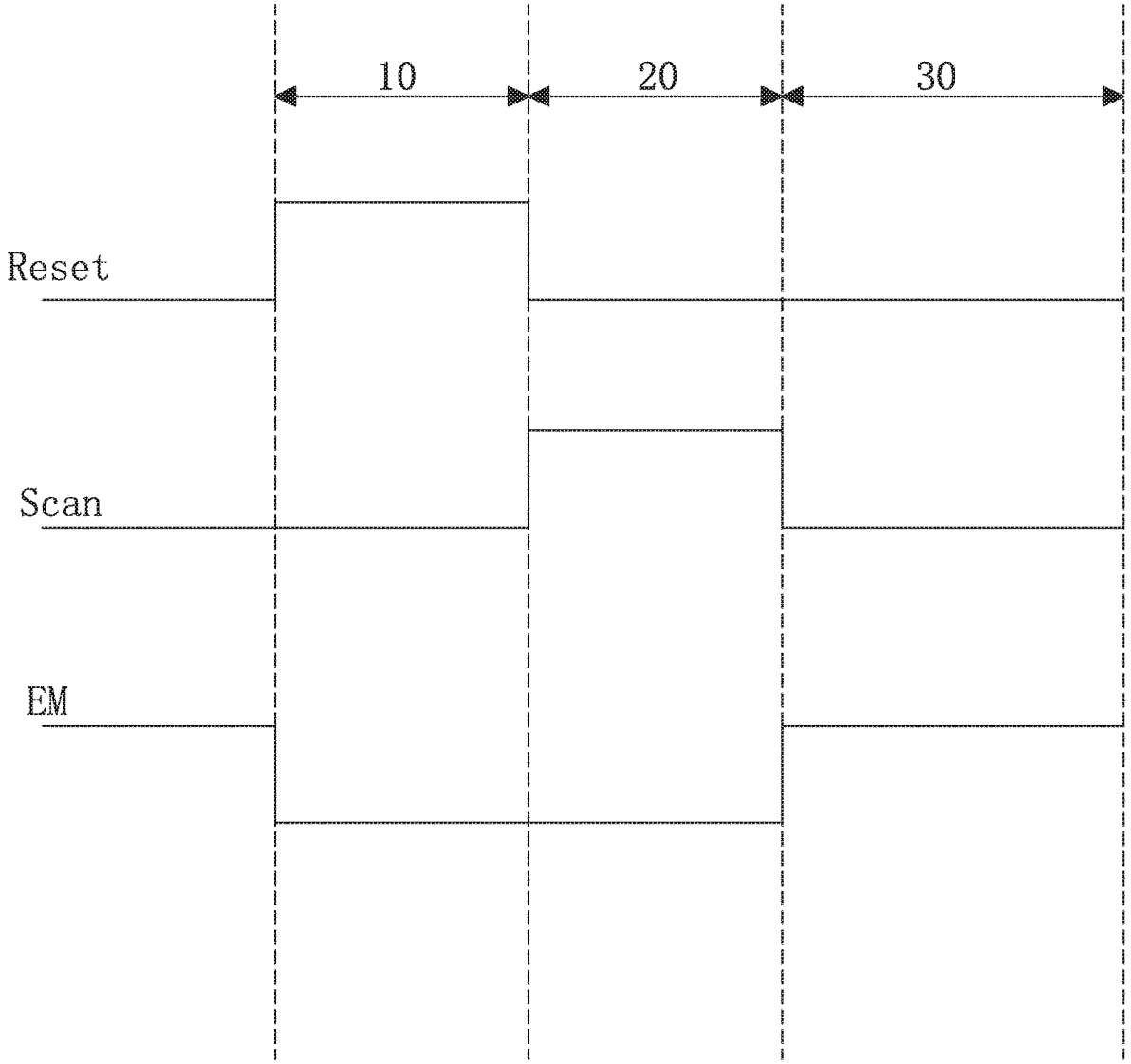
FIG. 4 is a timing diagram of the pixel driving circuit in accordance with the present disclosure.

It is to be noted that, referring to FIG. 4, an operating process of the pixel driving circuit includes: a reset stage 10, a compensation stage 20, and a light emission stage 30 in order.

During the reset stage 10, the reset control signal Reset is asserted, and the scan signal Scan and the light emission control signal EM are deasserted. During the reset stage 10, main operations are that two ends of the storage capacitor C1 of the compensation module 2 are reset, causing the first node G and the fourth node A to have a same electric potential.

During the compensation stage 20, the scan signal Scan is asserted, and the reset control signal Reset and the light emission control signal EM are deasserted. During the compensation stage 20, main operations are that the data signal Data is written to the fourth node A, the compensation voltage Vi is written to the third node B, and a capturing current flowing from the second node C to the third node B is formed, causing a voltage of the first node G to be equal to a sum of the compensation voltage Vi and a threshold voltage Vth of the fourth TFT. Therefore, capturing the threshold voltage Vth of the fourth TFT T4 is completed.

During the light emission stage 30, the light emission control signal EM is asserted, and the reset control signal Reset and light emission control signal EM are deasserted. During the light emission stage 30, main operations are that the high power supply voltage Vdd is provided and the EL element D1 is driven to emit light.

Specifically, the first TFT T1, the second TFT T2, the third TFT T3, the fourth TFT T4, the fifth TFT T5, the sixth TFT T6, the seventh TFT T7, and the eighth TFT T8 are N-type TFTs. Therefore, correspondingly, when each of the reset control signal Reset, the scan signal Scan, and the light emission control signal EM is asserted, each of the reset control signal Reset, the scan signal Scan, and the light emission control signal EM is at a high voltage level. When each of the reset control signal Reset, the scan signal Scan, and the light emission control signal EM is deasserted, each of the reset control signal Reset, the scan signal Scan, and the light emission control signal EM is at a low voltage level.

Figure 5:
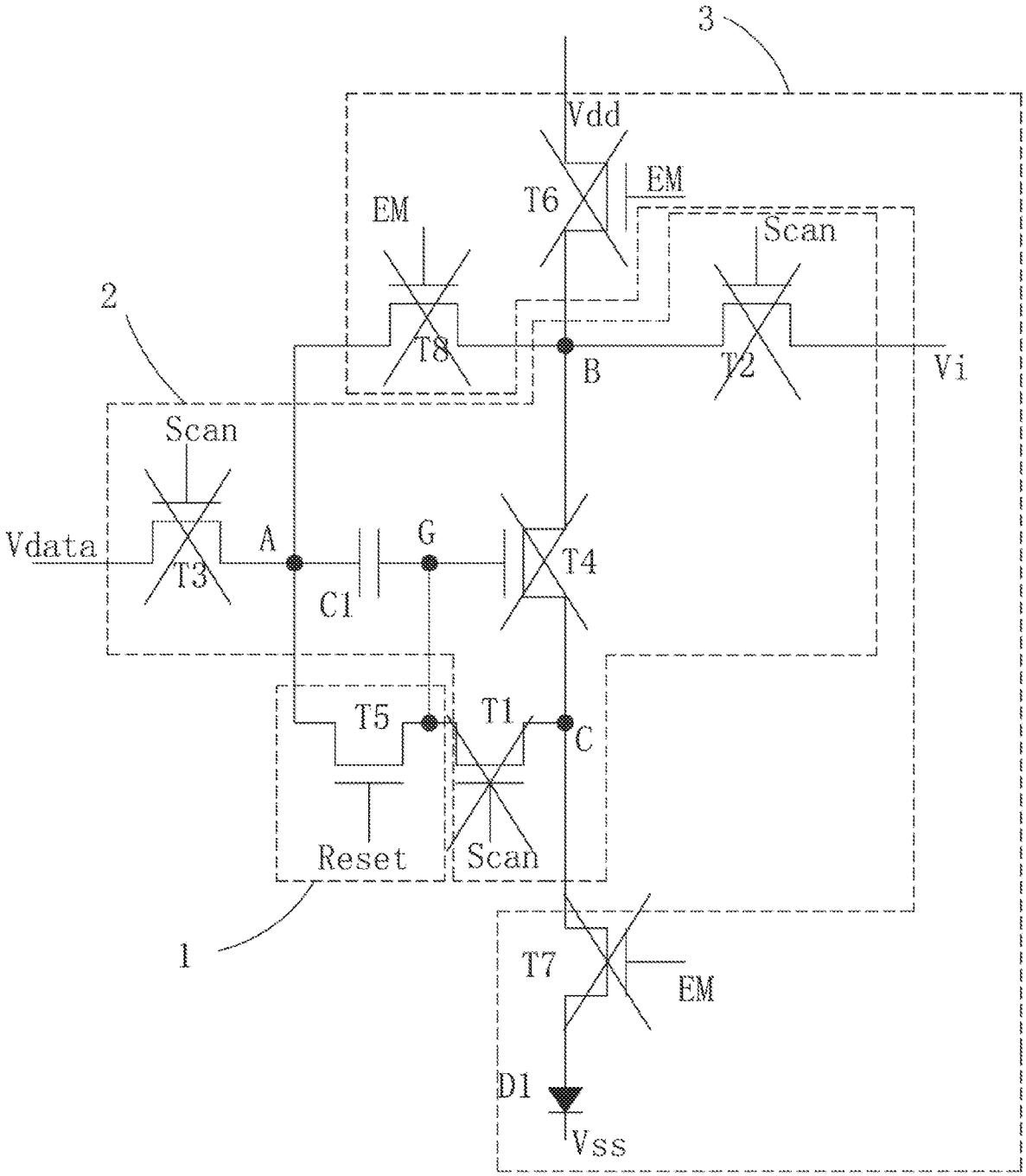
FIG. 5 is a schematic diagram illustrating operations of the pixel driving circuit in accordance with the present disclosure during a reset stage.
Figure 6:
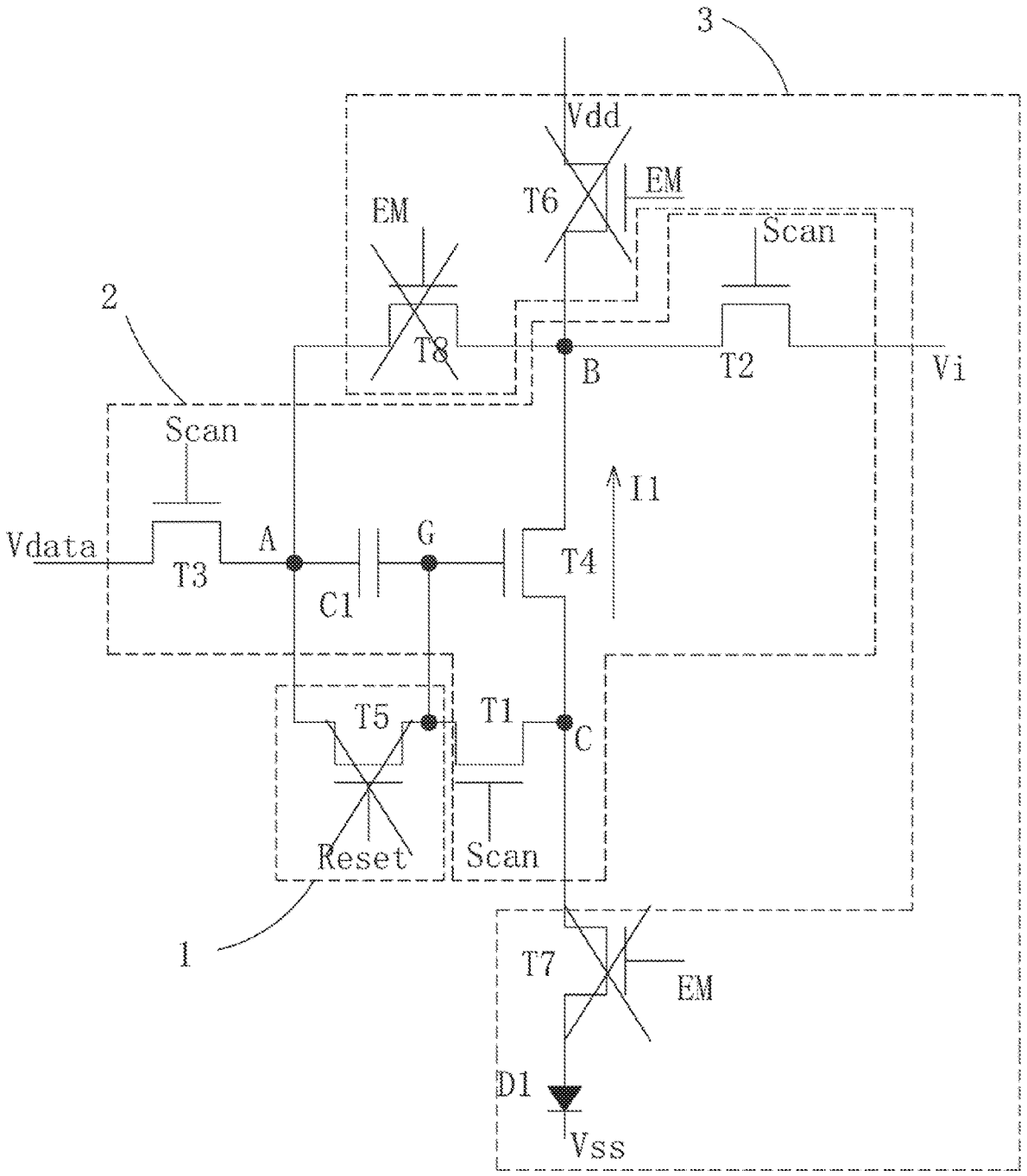
FIG. 6 is a schematic diagram illustrating operations of the pixel driving circuit in accordance with the present disclosure during a compensation stage.
Figure 7:
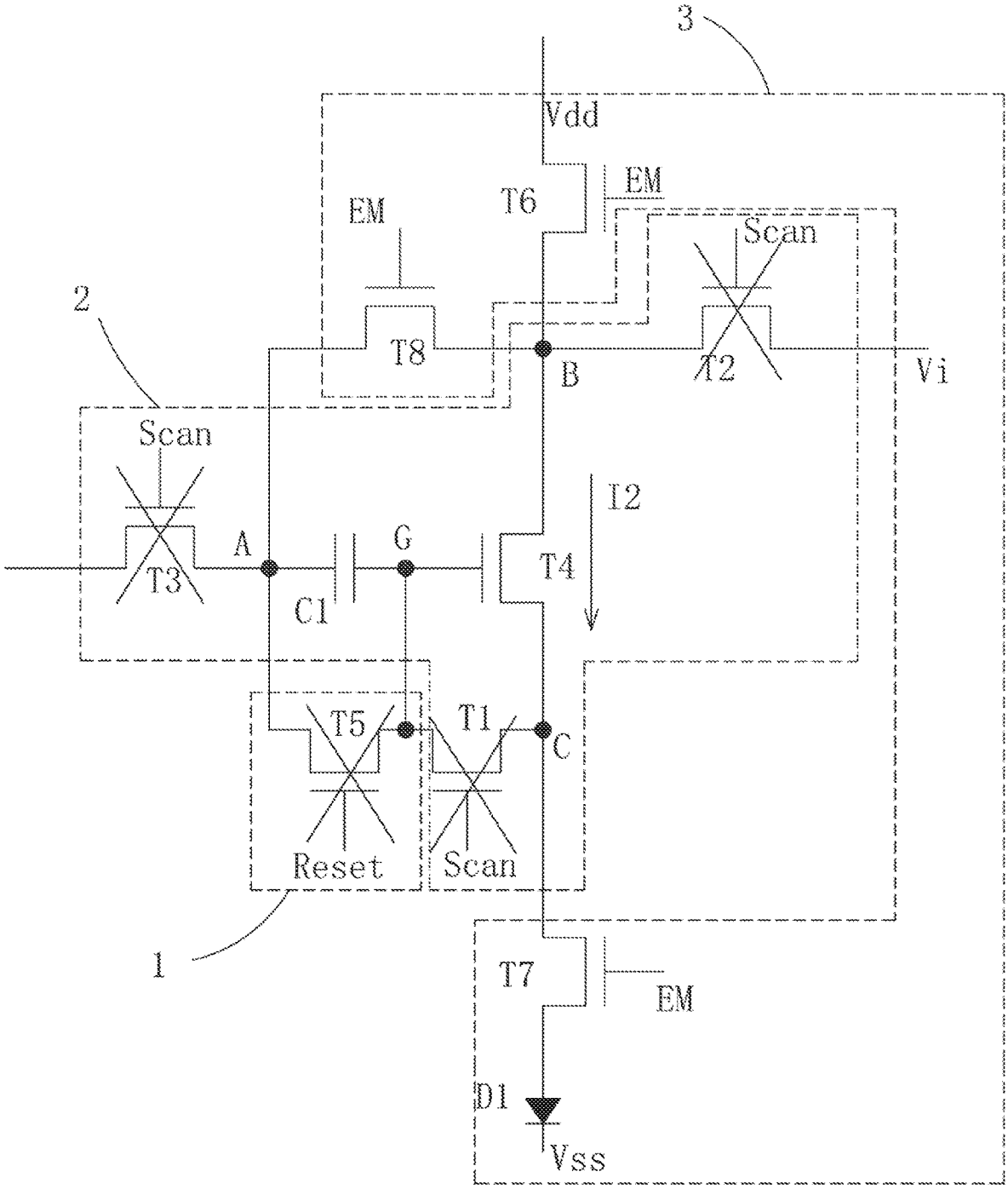
FIG. 7 is a schematic diagram illustrating operations of the pixel driving circuit in accordance with the present disclosure during a light emission stage.
Figure 8:
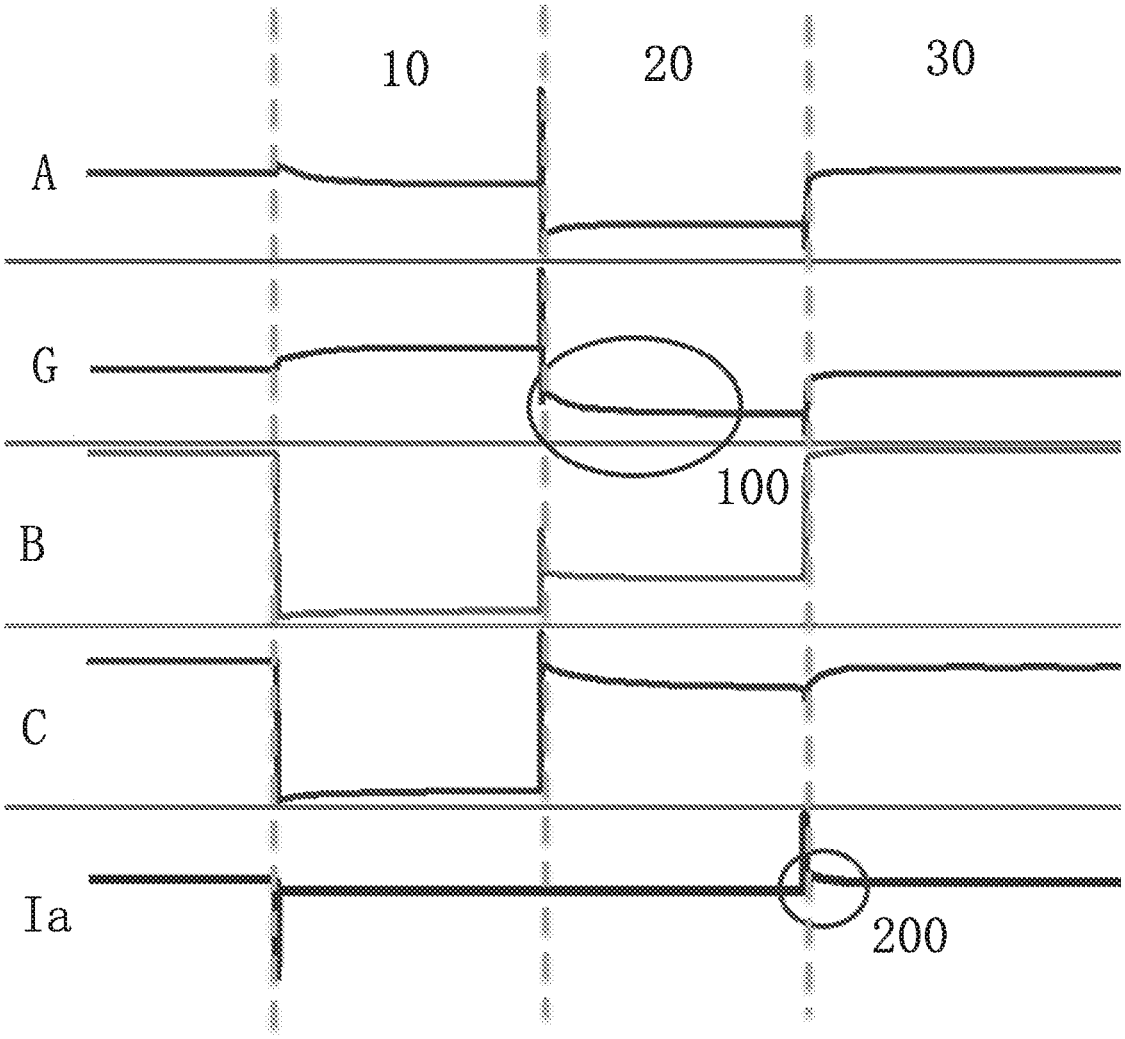
FIG. 8 is a waveform diagram illustrating a voltage of each node and a current at an anode of an electroluminescence (EL) element of the pixel driving circuit in accordance with the present disclosure during an operating process.

Referring to FIGS. 5 to 7 in conjunction with FIG. 8, the operating process of the pixel driving circuit is described in detail.

As illustrated in FIGS. 5 and 8, during the reset stage 10, the reset control signal Reset is at the high voltage level, and the scan signal Scan and the light emission control signal EM is at the low voltage level. The fifth TFT T5 is conducting, and the rest of the TFTs are cutoff. The fifth TFT T5 connects the first node G to the fourth node A, and also causes the two ends of the storage capacitor C1 to be connected together, causing voltages of the two ends of the storage capacitor C1 to be reset to be equal to each other.

As illustrated in FIGS. 6 and 8, during the compensation stage 20, the scan signal Scan is at the high voltage level, and the reset control signal Reset and the light emission control signal EM are at the low voltage level. The first TFT to the fourth TFT T1, T2, T3, and T4 are conducting, and the fifth TFT to the eighth TFT T5, T6, T7, and T8 are cutoff. The conducting third TFT T3 writes the data signal Data to the fourth node A, causing a voltage of the fourth node A to become a voltage Vdata of the data signal Data. The conducting second TFT T2 writes the compensation voltage Vi to the third node B. The storage capacitor C1 starts to discharge through the first TFT T1 and the fourth TFT T4 until the voltage of the first node G is higher than the voltage of the third node B by the threshold voltage Vth of the fourth TFT T4, i.e. the voltage of the first node G is equal to the sum of the compensation voltage Vi and the threshold voltage Vth of the fourth TFT T4, to capture the threshold voltage Vth of the fourth TFT T4. In FIG. 8, a position 100 is a waveform of the first node G when the threshold voltage Vth of the fourth TFT T4 is captured. During capturing, a direction of a current I1 flowing through the fourth TFT T4 is from the second node C to the third node B.

As illustrated in FIGS. 7 and 8, during the light emission stage 30, the light emission control signal EM is at the high voltage level, and the reset control signal Reset and the scan signal Scan are at the low voltage level. The first TFT to the fifth TFT T1, T2, T3, T4, and T5 are cutoff, and the sixth TFT to the eighth TFT T6, T7, and T8 are cutoff conducting. The conducting sixth TFT T6 causes the third node B to receive the high power supply voltage Vdd. The conducting eighth TFT T8 transmits the high power supply voltage Vdd of the third node B to the fourth node A, causing the voltage of the fourth node A to become the high power supply voltage Vdd. By the coupling effect of the storage capacitor C1, the voltage of the first node G becomes a difference between a sum of the compensation voltage Vi, the threshold voltage Vth of the fourth TFT T4, and the high power supply voltage Vdd, and the voltage Vdata of the data signal Data, expressed as Vi+Vth+Vdd−Vdata. A current I2 flowing through the EL element D1 is provided by the following equation.

$$I2=k\times(Vgs-Vth)^2$$

$$=k\times(Vi+Vth+Vdd-V\text{data}-Voled-Vth)^2$$

$$=k\times(Vi+Vdd-V\text{data}-Voled)^2;$$

where k is a constant coefficient related to characteristics of the fourth TFT T4, and Voled is a voltage across two ends of the EL element D1. From the above equation, the current I2 flowing through the EL element D1 is not related to the threshold voltage Vth of the fourth TFT T4. Therefore, a problem that the threshold voltage Vth of the fourth TFT T4 causes an image to be poorly displayed is eliminated.

Further, as illustrated in FIG. 8, during the light emission stage 30, a current Ia at the anode of the EL element D1 is significantly increased at position 200, and the EL element D1 emits light stably.

It is to be noted that during the operating process of the pixel driving circuit, the flowing direction of the current I1 when the threshold voltage of the fourth TFT T4 is captured is from the second node C to the third node B. A flowing direction of the current I2 when the EL element D1 emits light is from the third node B to the second node C. The two directions are opposite to each other. Therefore, aging of the fourth TFT T4 is alleviated, and life of the fourth TFT T4 is extended. Also, the EL element D1 is prevented from emitting light when the threshold voltage of the fourth TFT T4 emit is captured. Therefore, a problem that the EL element D1 emits undesired light is reduced.

In addition, the present disclosure also provides a display device including any of the aforementioned pixel driving circuits.

In summary, the pixel driving circuit includes: a reset module, a compensation module electrically connected to the reset module, and a light emission module electrically connected to the compensation module. The reset module is configured to receive a reset control signal, and, in response to the reset control signal, reset the compensation module. The compensation module is configured to receive a scan signal, and, in response to the scan signal, receive a data signal and a compensation voltage, to complete performing threshold voltage compensation. The light emission module is configured to receive a light emission control signal, and, in response to the light emission control signal, emit light. Therefore, a threshold voltage is effectively compensated, and contrast of a displayed image is increased. The present disclosure also provides a display device that effectively compensates a threshold voltage, and increases contrast of a displayed image.

To persons skilled in the art, in accordance with the technical solutions and technical ideas of the present disclosure, various changes and modifications may be made to the description above. All these changes and modifications are within the protection scope of the claims of the present disclosure.

What is claimed is:

1. A pixel driving circuit, comprising: a reset module, a compensation module electrically connected to the reset module, and a light emission module electrically connected to the compensation module;

wherein the reset module is configured to receive a reset control signal, and, in response to the reset control signal, reset the compensation module;

wherein the compensation module is configured to receive a scan signal, and, in response to the scan signal, receive a data signal and a compensation voltage, and perform threshold voltage compensation; and wherein the light emission module is configured to receive a light emission control signal, and, in response to the light emission control signal, emit light.

2. The pixel driving circuit of claim 1, wherein the compensation module comprises: a first thin film transistor (TFT), a second TFT, a third TFT, a fourth TFT, and a storage capacitor;

wherein the first TFT has a gate receiving the scan signal, a source electrically connected to a first node, and a drain electrically connected to a second node;

wherein the second TFT has a gate receiving the scan signal, a source receiving the compensation voltage, and a drain electrically connected to a third node;

wherein the third TFT has a gate receiving the scan signal, a source receiving the data signal, and a drain electrically connected to a fourth node;

wherein the fourth TFT has a gate electrically connected to the first node, a source electrically connected to the second node, and a drain electrically connected to the third node;

wherein the storage capacitor has two ends correspondingly electrically connected to the first node and the fourth node; and wherein the reset module is electrically connected to the first node and the fourth node, and the light emission module is electrically connected to the second node, the third node, and the fourth node.

3. The pixel driving circuit of claim 2, wherein the reset module comprises: a fifth TFT;

wherein the fifth TFT has a gate receiving the reset control signal, a source electrically connected to the first node, and a drain electrically connected to the fourth node.

4. The pixel driving circuit of claim 3, wherein the light emission module comprises: a sixth TFT, a seventh TFT, an eighth TFT, and an electroluminescence (EL) element;

wherein the sixth TFT has a gate receiving the light emission control signal, a source receiving a high power supply voltage, and a drain electrically connected to the third node;

wherein the seventh TFT has a gate receiving the light emission control signal, a source electrically connected to the second node, and a drain electrically connected to an anode of the EL element;

wherein the eighth TFT has a gate receiving the light emission control signal, a source electrically connected to the third node, and a drain electrically connected to the fourth node; and wherein a cathode of the EL element receives a low power supply voltage.

5. The pixel driving circuit of claim 4, wherein an operating process of the pixel driving circuit comprises: a reset stage, a compensation stage, and a light emission stage in order;

wherein during the reset stage, the reset control signal is asserted, and the scan signal and the light emission control signal are deasserted;

wherein during the compensation stage, the scan signal is asserted, and the reset control signal and the light emission control signal are deasserted; and wherein during the light emission stage, the light emission control signal is asserted, and the reset control signal and light emission control signal are deasserted.

6. The pixel driving circuit of claim 5, wherein the first TFT, the second TFT, the third TFT, the fourth TFT, the fifth TFT, the sixth TFT, the seventh TFT, and the eighth TFT are N-type TFTs;

wherein when each of the reset control signal, the scan signal, and the light emission control signal is asserted, each of the reset control signal, the scan signal, and the light emission control signal is at a high voltage level; and wherein when each of the reset control signal, the scan signal, and the light emission control signal is deasserted, each of the reset control signal, the scan signal, and the light emission control signal is at a low voltage level.

7. The pixel driving circuit of claim 5, wherein during the reset stage, a voltage of the first node is equal to a voltage of the fourth node.

8. The pixel driving circuit of claim 5, wherein during the compensation stage, a voltage of the fourth node is equal to a voltage of the data signal, a voltage of the first node is equal to a sum of the compensation voltage and a threshold voltage of the fourth TFT.

9. The pixel driving circuit of claim 5, wherein during the light emission stage, a voltage of the fourth node is equal to the high power supply voltage, a voltage of the first node is equal to a difference between a sum of the compensation voltage, a threshold voltage of the fourth TFT, and the high power supply voltage, and a voltage of the data signal.

10. A display device, comprising: a pixel driving circuit, wherein the pixel driving circuit comprises: a reset module, a compensation module electrically connected to the reset module, and a light emission module electrically connected to the compensation module;

wherein the reset module is configured to receive a reset control signal, and, in response to the reset control signal, reset the compensation module;

wherein the compensation module is configured to receive a scan signal, and, in response to the scan signal, receive a data signal and a compensation voltage, and perform threshold voltage compensation; and wherein the light emission module is configured to receive a light emission control signal, and, in response to the light emission control signal, emit light.

11. The display device of claim 10, wherein the compensation module comprises: a first thin film transistor (TFT), a second TFT, a third TFT, a fourth TFT, and a storage capacitor;

wherein the first TFT has a gate receiving the scan signal, a source electrically connected to a first node, and a drain electrically connected to a second node;

wherein the second TFT has a gate receiving the scan signal, a source receiving the compensation voltage, and a drain electrically connected to a third node;

wherein the third TFT has a gate receiving the scan signal, a source receiving the data signal, and a drain electrically connected to a fourth node;

wherein the fourth TFT has a gate electrically connected to the first node, a source electrically connected to the second node, and a drain electrically connected to the third node;

wherein the storage capacitor has two ends correspondingly electrically connected to the first node and the fourth node; and wherein the reset module is electrically connected to the first node and the fourth node, and the light emission module is electrically connected to the second node, the third node, and the fourth node.

12. The display device of claim 11, wherein the reset module comprises:

a fifth TFT;

wherein the fifth TFT has a gate receiving the reset control signal, a source electrically connected to the first node, and a drain electrically connected to the fourth node.

13. The display device of claim 12, wherein the light emission module comprises: a sixth TFT, a seventh TFT, an eighth TFT, and an electroluminescence (EL) element;

wherein the sixth TFT has a gate receiving the light emission control signal, a source receiving a high power supply voltage, and a drain electrically connected to the third node;

wherein the seventh TFT has a gate receiving the light emission control signal, a source electrically connected to the second node, and a drain electrically connected to an anode of the EL element;

wherein the eighth TFT has a gate receiving the light emission control signal, a source electrically connected to the third node, and a drain electrically connected to the fourth node; and wherein a cathode of the EL element receives a low power supply voltage.

14. The display device of claim 13, wherein an operating process of the pixel driving circuit comprises: a reset stage, a compensation stage, and a light emission stage in order;

wherein during the reset stage, the reset control signal is asserted, and the scan signal and the light emission control signal are deasserted;

wherein during the compensation stage, the scan signal is asserted, and the reset control signal and the light emission control signal are deasserted; and wherein during the light emission stage, the light emission control signal is asserted, and the reset control signal and light emission control signal are deasserted.

15. The display device of claim 14, wherein the first TFT, the second TFT, the third TFT, the fourth TFT, the fifth TFT, the sixth TFT, the seventh TFT, and the eighth TFT are N-type TFTs;

wherein when each of the reset control signal, the scan signal, and the light emission control signal is asserted, each of the reset control signal, the scan signal, and the light emission control signal is at a high voltage level; and wherein when each of the reset control signal, the scan signal, and the light emission control signal is deasserted, each of the reset control signal, the scan signal, and the light emission control signal is at a low voltage level.

16. The display device of claim 14, wherein during the reset stage, a voltage of the first node is equal to a voltage of the fourth node.

17. The display device of claim 14, wherein during the compensation stage, a voltage of the fourth node is equal to a voltage of the data signal, a voltage of the first node is equal to a sum of the compensation voltage and a threshold voltage of the fourth TFT.

18. The display device of claim 14, wherein during the light emission stage, a voltage of the fourth node is equal to the high power supply voltage, a voltage of the first node is equal to a difference between a sum of the compensation voltage, a threshold voltage of the fourth TFT, and the high power supply voltage, and a voltage of the data signal.

* * * * *